US005190178A

United States Patent [19]

Luch

[11] Patent Number: 5,190,178

[45] Date of Patent: Mar. 2, 1993

[54] SNAP-ON, SCREW-OFF CAP AND CONTAINER NECK

[75] Inventor: Daniel Luch, Los Gatos, Calif.

[73] Assignee: Cap Snap Co, San Jose, Calif.

[21] Appl. No.: 565,638

[22] Filed: Aug. 9, 1990

[51] Int. Cl.[5] ..... B65D 41/34

[52] U.S. Cl. ..... 215/256; 215/318; 215/320; 215/329; 215/354

[58] Field of Search ..... 215/252, 254, 256, 318, 215/329, 320, 253, 354, 356, 357

[56] References Cited

U.S. PATENT DOCUMENTS

| | | | |
|---|---|---|---|
| 1,630,687 | 5/1927 | Aulbach | 220/296 X |
| 2,181,340 | 11/1939 | Plumb | 220/296 |
| 3,022,917 | 2/1962 | Montgomery | 220/296 X |
| 3,223,269 | 12/1965 | Williams | 215/318 |
| 3,695,475 | 10/1972 | Ruckberg | 215/318 X |
| 3,837,518 | 9/1974 | Gach | 215/256 X |
| 3,844,443 | 10/1974 | Cudzik | 220/296 |
| 3,902,621 | 9/1975 | Hidding | 215/252 |
| 3,980,195 | 9/1976 | Fillmore | 215/256 |
| 4,241,841 | 12/1980 | Boller | 215/252 |
| 4,278,129 | 11/1981 | Stull | 215/224 |
| 4,354,609 | 10/1982 | Hidding | 215/252 |
| 4,385,708 | 5/1983 | Curry | 215/256 |
| 4,448,319 | 5/1984 | Kern | 215/329 |
| 4,548,329 | 10/1985 | Curry | 215/216 |
| 4,561,553 | 12/1985 | Crisci | 215/256 |
| 4,625,875 | 12/1986 | Carr et al. | 215/232 |
| 4,744,478 | 5/1988 | Hahn | 215/252 |
| 4,844,250 | 7/1989 | Holoubek et al. | 222/107 |
| 4,981,230 | 1/1991 | Marshall et al. | 215/252 |
| 4,989,740 | 2/1991 | Verdillo | 215/252 |

FOREIGN PATENT DOCUMENTS

| | | | |
|---|---|---|---|
| 812597 | 5/1969 | Canada | 215/318 |
| 0118267 | 10/1986 | European Pat. Off. . | |
| 1154369 | 9/1963 | Fed. Rep. of Germany | 215/252 |
| 2356007 | 5/1974 | Fed. Rep. of Germany | 215/252 |
| 2105693 | 3/1983 | United Kingdom | 215/252 |

*Primary Examiner*—Stephen Marcus
*Assistant Examiner*—Stephen Cronin
*Attorney, Agent, or Firm*—Julian Caplan

[57] ABSTRACT

A tamper-evident, snap-on, screw-off closure is used with a specially shaped container neck. The neck has double lead external threads and, below the threads, external ratchet teeth arranged in two diametrically opposed quadrants. The closure has an upper skirt having internal threads mating with the neck threads. A lower skirt is connected to the upper skirt by a plurality of frangible bridges. The lower skirt has opposed quadrants having internal ratchet teeth to mate with the neck ratchet teeth. The lower skirt has a tear tab which, when pulled, fractures the lower skirt on a vertical line. Continued pulling on the tab sequentially fractures the bridges. The tear tab constitutes an orientation means to properly locate the cap on the neck so that an axial downward push on the cap engages the internal and external threads and internal and external ratchet teeth.

43 Claims, 5 Drawing Sheets

SNAP-ON, SCREW-OFF CAP AND CONTAINER NECK

BACKGROUND OF THE INVENTION

1. Field of the Invention

This invention relates to a new and improved container closure and container neck structure and more particularly to a structure wherein the closure is applied with a single one-dimensional axial downward force onto the neck and is held in such position by a tamper-evident band. The consumer destroys a frangible section during initial removal, preferably by tearing away of the band enabling the closure to be screwed off the container neck. When the cap is used for reclosure purposes, it may be screwed on and screwed off in the same manner as screw caps have heretofore been used.

2. Description of Related Art

Prior snap-on, screw-off structures may be classified under either of the following categories:

(1) Those with thread engagement as initially applied, (2) Those without.

The major advantages of the no-thread initial engagement systems are that they are conceptually simple, careful alignment of the closure and the container is not necessary upon application of the closure, easy (low force) application is possible since no thread-jumping is required. This version can be an aesthetically pleasing, straight wall cap design, and good re-seal is achieved on reclosure because of the torque advantage of threads. On the other hand, the disadvantages of such a system are that it may be confusing to the consumer because initial removal is merely by lifting the cap off the neck but subsequent use requires twisting the cap relative to the neck. Further, it is difficult to use the system with a lined closure because of the height relationships between the finish and the cap, and finally the cap must be relatively tall, which forces the use of fine threads, which can be difficult to mole. None of these disadvantages are present in this invention.

A closure such as Cresci U.S. Pat. No. 4,561,553 has a number of problems. The tamper evident feature of the closure may be circumvented by being able to engage the threads of the neck and closure (thereby creating a mechanical advantage) and back off the cap while the tamper-evident band is intact. Secondly, the device is confusing to the consumer since the cap is screwed off during removal only by inwardly distorting the cap skirt. The cap is reapplied as a standard snap cap.

Full thread engagement as the cap is initially applied has a number of conceptual advantages. Consumer confusion is eliminated since initial removal is by unscrewing. A number of seal systems, including foil, full liner, plugs or other linerless seals can be used. However, full engagement systems heretofore have been difficult to achieve in practice. A disadvantage of a closure such as Carr U.S. Pat. No. 4,625,875 is that there is no practical, consistent means to orient the cap relative to the container so that, after application, the cap must be turned at least slightly to ensure seal. This defeats the purpose of a push-on cap. Also, the use of a stretch snap-band tamper evident ring excessively increases the application force necessary to seat the cap.

The present invention provides full thread engagement by reason of unique thread design and, more particularly, a unique tamper-evident band attached to the cap by multiple bridges, as well as a means of orienting closure and bottle threads to achieve registration prior to straight axial application.

The present invention has considerable advantages over prior structures for the reasons above noted, among others.

SUMMARY OF THE INVENTION

The present invention comprises an improved closure or cap and an improved neck finish. The cap skirt and neck are provided with mating threads of such shape that the cap may be applied in a single downward vertical movement, the cap skirt and neck flexing sufficiently to permit the threads to slip relative to each other.

The threads may be continuous or interrupted. Also, instead of there being two external threads—one on the neck and one on the cap, one external thread may be replaced with a groove. The term "helical engagement means" is sometimes used herein to encompass all such screw retention means.

The cap has a tamper-evident tear band below the skirt which is connected to the skirt by a plurality of bridges. Ratchet teeth are positioned in the tamper evident band in two facing quadrants around the circumference. Correspondingly, the container neck below the threads is formed with external ratchet teeth. The mating ratchet teeth of the cap and container neck are engaged by the initial downward movement of the cap relative to the neck. In other words, in order to engage the ratchet teeth it is not necessary to rotate the cap relative to the neck, thereby differing from conventional threaded tamper-evident caps. It is merely necessary to provide alignment means on the cap and on the container so that the cap is initially properly oriented in such position that a direct single vertically downward movement of the cap relative to the neck causes the threads to slip relative to each other and the ratchet teeth to lock in final position Chamfers on the ratchet structure of either closure or container can be used as a "fine" orientation system as the closure is initially applied.

To achieve proper registration of threads when a simple direct axial application force is used, both the neck threads and closure threads must be oriented. Orientation of the container is relatively easy. Generally, containers are either non-circular or have non-circular features which may be used to properly orient the container. In accordance with a preferred form of the invention shown herein, the closure has a downward projecting tab similar to the tear tab used on push-on tear-off closures. The vertical tear tab characteristic of the present closure is an excellent orientation feature. However, other means for orienting the cap and container may be used.

Thread design is another feature of the invention. A large number of threads per inch of axial height is desirable for two reasons. First, a fine thread may be used and such a thread does not have to be as deep as a coarse thread, and hence the forces required for threads to jump during application are minimized. Secondly, fine threads minimize the height required to achieve a standard design criterion of 360° of thread engagement which permits a lighter closure weight.

The greater the number of thread leads, the less actual turning action is required to remove or reapply the cap. In addition, additional thread leads promote more "squareness" during straight axial application. In other words, the cap seats horizontally on the neck because the terminii of the threads are diametrically opposed or, at least, statically balanced. However, additional leads require a higher thread pitch assuming constant threads per inch and excessively high thread pitch results in a situation where the closure may back off or unscrew itself from sealed position. In accordance with the present invention, a preferred thread for a blow-molded, high density polyethylene bottle is 12 threads per inch and two leads. If bottle finish processing permits, it would be advantageous to design for higher threads per inch and more leads. For example, if the bottle is made with injection blow equipment, a very fine bottle thread is possible. In that case, it is preferable to use, for example, a 16 thread-per-inch, 4 lead, 4 pitch thread. The more leads, the more squarely the cap sets on the neck and the more effectively the closure will be seated by a direct downward, axial application force.

In order to provide a tamper-evident feature, the closure should not be removable without some apparent closure characteristic changing. Generally, this requirement is satisfied by incorporating a frangible section which is destroyed during initial closure removal. One type of frangible section is a continuous thinned tear line, but in a cap of the present invention, such a system may not be the best choice, although permissible. A preferred tamper-evident feature provides a frangible section having a number of frangible connections or bridges between the closure skirt and a tamper-evident ring below the bottom edge of the skirt. The preferred approach is to incorporate enough bridges around the circumference such that the combined strength of the bridges prevents unscrewing. The tamper evident band must be removed to allow unscrewing. Sequential breaking of the many bridges around the circumference simulates a continuous tear. A second approach is to incorporate only a few bridges around the circumference of the skirt such that the combined strength of the bridges is not sufficient to prevent unscrewing and the bridges rupture as the cap is initially unscrewed. With this second approach the broken bridges give evidence of opening. A major advantage of using bridges rather than a continuous tear strip is that a wide range of material choices is possible. Therefore a multiple bridge simulated tear structure is generally preferred over continuous tear frangible sections and this approach is used in the preferred embodiments of the present invention.

In a preferred embodiment of the invention hereinafter described in detail, the closure is first oriented by means of its tear tab and the containers are together and the orientation allows registration of both the threads and the ratchets which hold the cap in place until the tamper-evident band is removed. Seal of the container may be made with a liner, foil or a linerless feature such as a plug or flap. Before initial removal, the multiple bridges are collectively sufficiently strong to prevent unscrewing and also resist any tendency of the closure to back off the neck. During initial removal, the tear band is removed through sequential breaking of the bridges, thereby simulating a continuous tear strip but allowing the use of such plastic materials as polypropylene and high density polyethylene. Once the tear band is removed, the system functions as with normal threaded closures. Alternatively the upper and lower portions of the cap skirt are connected by a plurality of angularly spaced bridges. Merely by twisting the upper skirt portion the bridges may be severed, giving evidence of tampering, and making it possible to unscrew the cap.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 5:
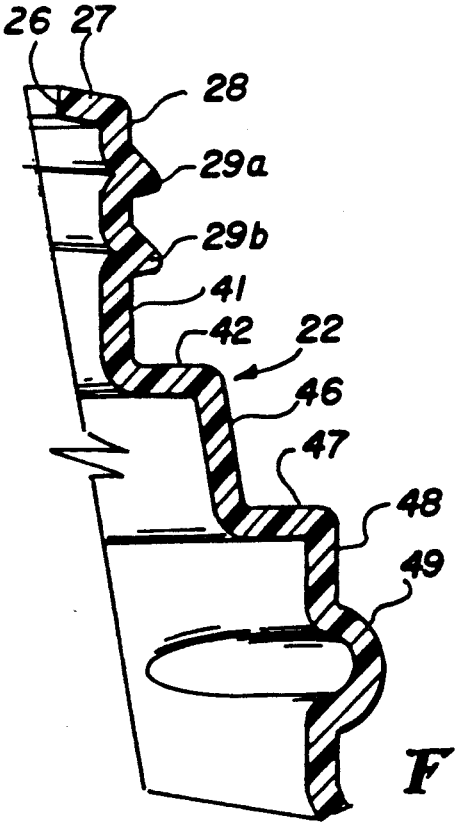
FIGS. 5 and 6 are fragmentary sectional views of a container neck taken substantially along lines 5—5 and 6—6 of FIG. 2, respectively.
Figure 6:
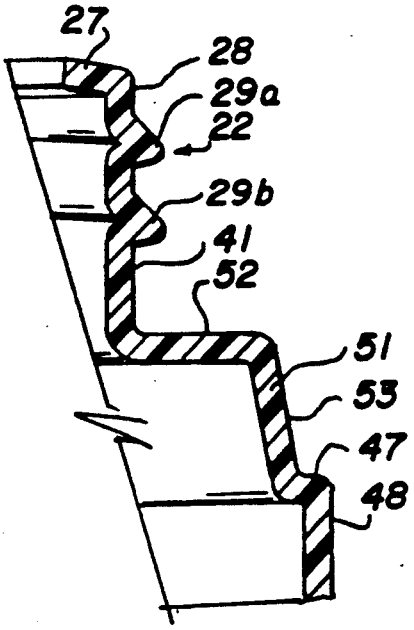

Cap 21, hereinafter described in detail, is used with a container neck 22. Neck 22 has a central neck opening 26 and extending outwardly thereof a downward-outward slanted lip flange 27 which terminates in a vertical stretch 28. The exterior of neck 22 is hereinafter described. The interior thereof forms no part of the present invention. With a blow-molded bottle as illustrated in FIGS. 5 and 6, the interior contour of the neck generally tends to follow that of the exterior. However, it will be understood that other types of bottles may be used and in such instances the internal neck shape may vary from that of the exterior.

Figure 3:
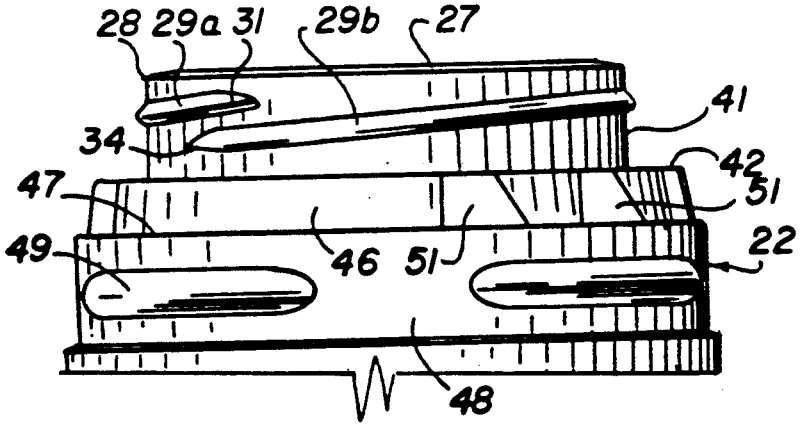
FIG. 3 is a side elevation view of a container neck in accordance with the present invention.
Figure 4:
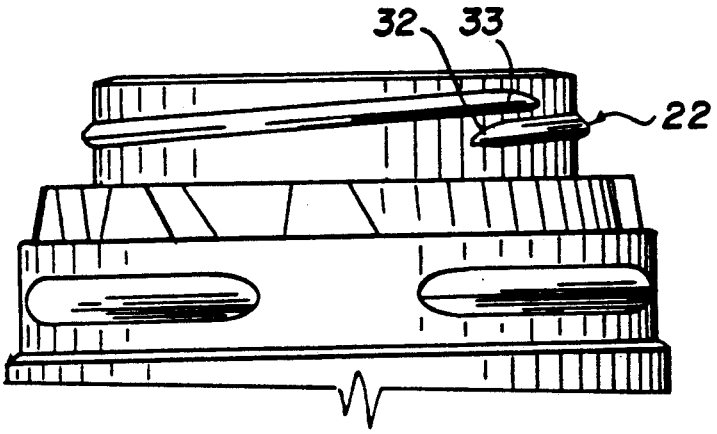
FIG. 4 is a view similar to FIG. 3 with the container neck rotated 90°.
Figure 7:
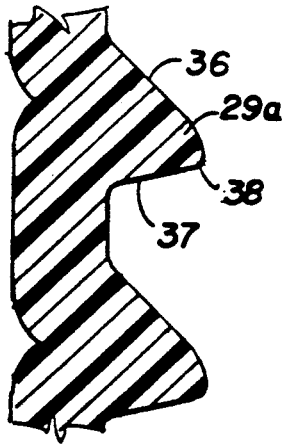
FIG. 7 is a schematic view of a preferred container thread configuration.
Figure 8:
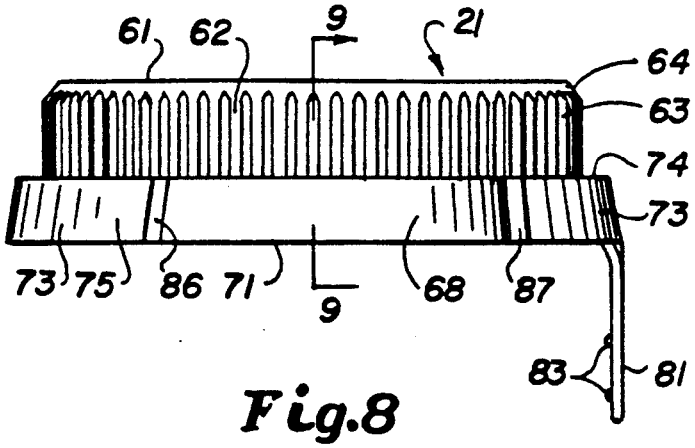
FIG. 8 is a side elevational view of a cap used with the present invention.

Extending outward of stretch 28 are threads 29. In the depicted embodiment of FIGS. 3 and 4 there are two threads 29 designated **29*a* and 29*b*. In the embodiment, the finish has twelve threads per inch with a double lead, each thread being six pitch and extending approximately 180° of a full thread. Thus the upper terminus 31 of the first thread is displaced approximately 180° from the lower terminus 32 thereof. The upper terminus 33 of the second thread is located diametrically opposite terminus 31 and its lower terminus is approximately diametrically opposite terminus 32. It is understood that the threads can be extended greater than 180° to achieve increased thread engagement. Also, additional thread leads and different linear thread density (threads per inch) are permitted and may be advantageously chosen. In order to permit the threads of the cap to slip past the threads of the neck, as shown in FIG. 7, the upper flank 36 of thread 29 slants downwardly/outwardly at approximately 45° while the lower flank 37 slants downwardly/inwardly at an angle of about 10°. Preferably the thread apex 38 is made with as large a radius as possible. A portion 41 of vertical stretch 28 is located below the threads 29 extending down to upper shoulder 42** which is horizontal.

As stated previously, instead of external threads or the inside of the skirt and outside of the cap, one thread may be a groove. Further, instead of threads 29 being continuous, they may be interrupted.

Below shoulder 42 is locking area wall 46 which slants downward/outward at an angle of about 10°. Wall 46 terminates in lower shoulder 47 which is also approximately horizontal. Outwardly of and below shoulder 47 is a lower vertical stretch 48 which at its lower end merges with the container. Bumper ring segments 49 (here shown as four in number) may be formed in the stretch 48 to facilitate gripping the container during filling and loading and also to provide certain vertical flexibility to the neck during the capping operation.

Figure 1:
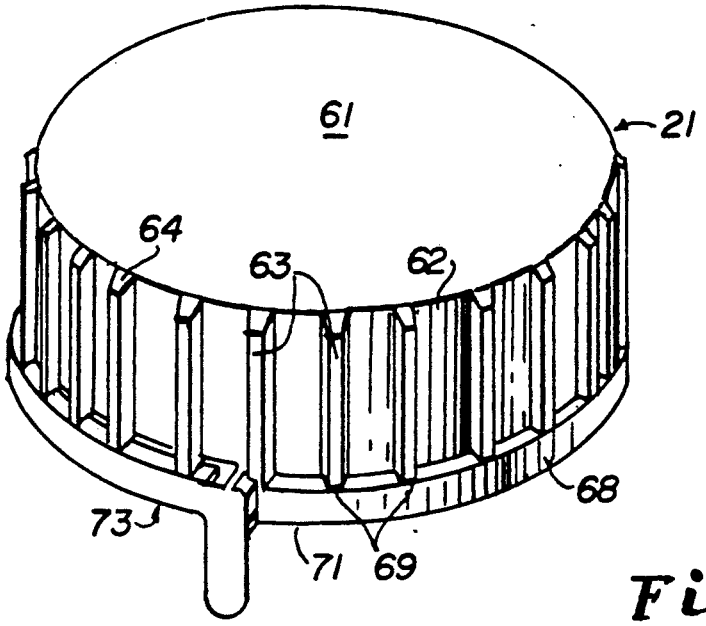
FIG. 1 is a perspective view of a preferred closure in accordance with the present invention.
Figure 2:
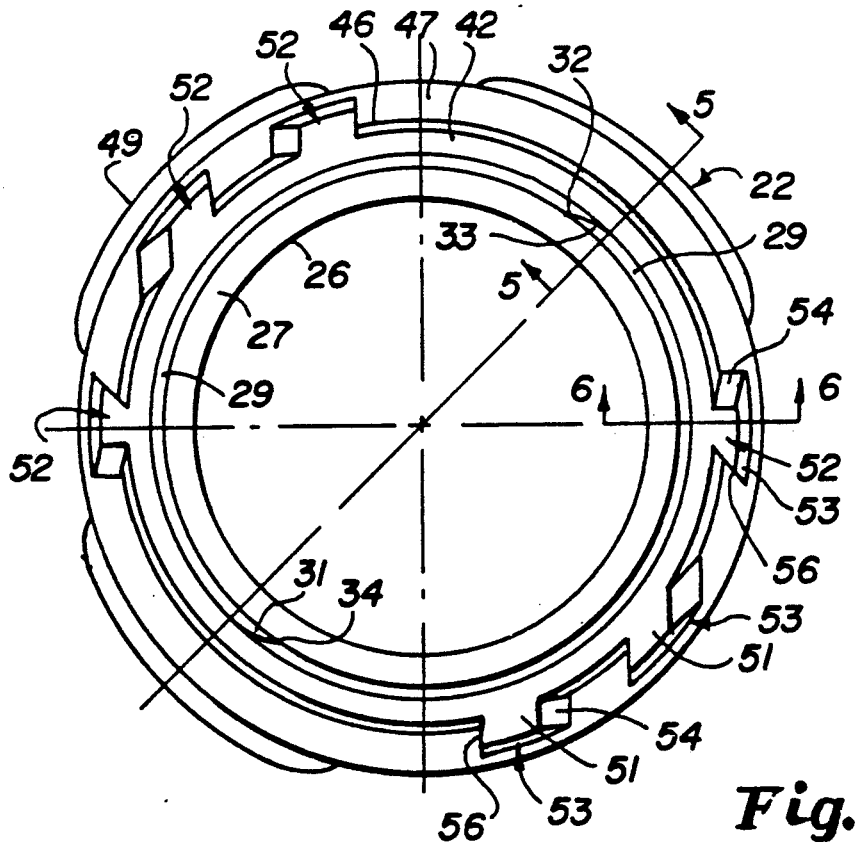
FIG. 2 is a top plan view of the container neck.

On opposite sides of neck 22 projecting out from wall 41 are teeth 51. As illustrated in FIG. 2, there are typically three such teeth on one side of the container neck and three teeth on the opposite side. The total extent of the three teeth on each side is approximately 90°. Each tooth has a top surface 52 which can be co-planar with the surface of shoulder 42. Outer surface 53 slants downward/outward at an angle of approximately 10°, terminating in shoulder 47. The front edge 54 viewed from above in plan as in FIG. 2 slants upwardly-forwardly in a clockwise direction of travel (assuming a right-hand thread) at an angle of approximately 60° to horizontal. The trailing edges 56 are disposed at varying angles from about 45° to about 0° relative to a radial line drawn perpendicular to the vertical axis and are approximately vertical.

A preferred cap 21 used with the neck structure 22 previously described is illustrated in FIGS. 1 and 8 through 13. The cap has a generally flat top disk 61 from the periphery of which depends substantially vertical upper-outer skirt 62. Skirt 62 has vertical ribs 63 spaced therearound to enable the user to grip the cap. Chamfers 64 are preferably formed on the upper edges of ribs 63.

On the interior of skirt 62 are formed threads **66*a* and 66*b* which are selected to mate with threads 29 of neck 22. The bottom edge 67 of upper skirt 62 is connected to generally downwardly/outwardly slanted lower skirt 68 by a plurality of bridges 69 which in fact constitute the lower edges of ribs 63. Skirt 68 has a generally horizontal lower edge 71**.

Figure 9:
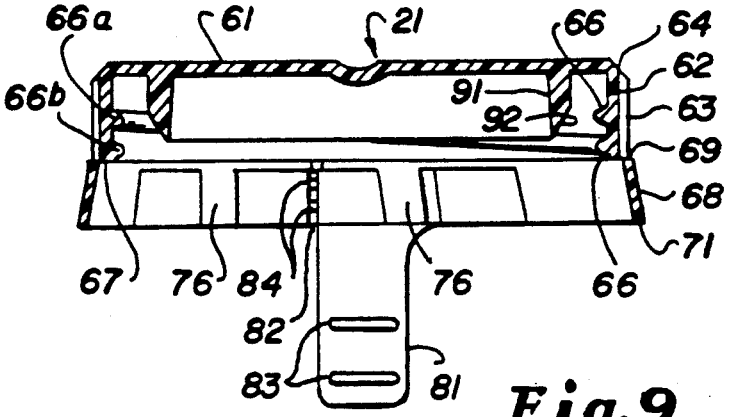
FIG. 9 is a sectional view taken substantially along line 9—9 of FIG. 8.
Figure 10:
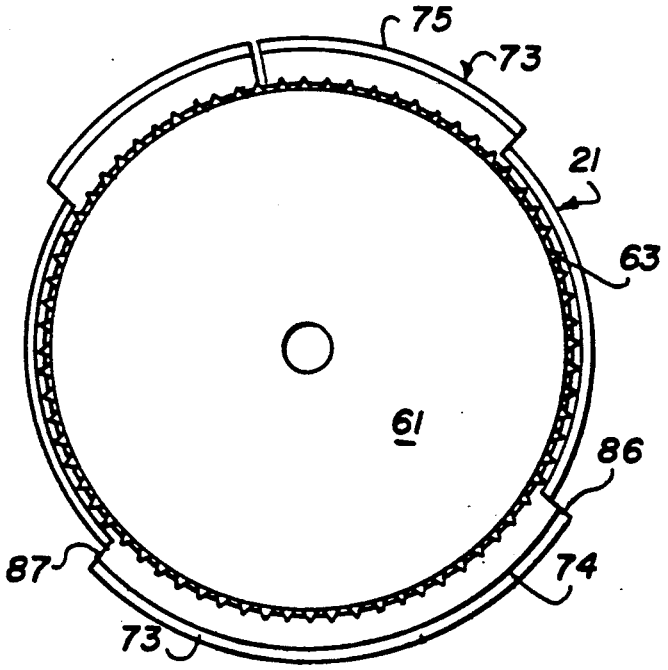
FIG. 10 is a top plan view.
Figure 11:
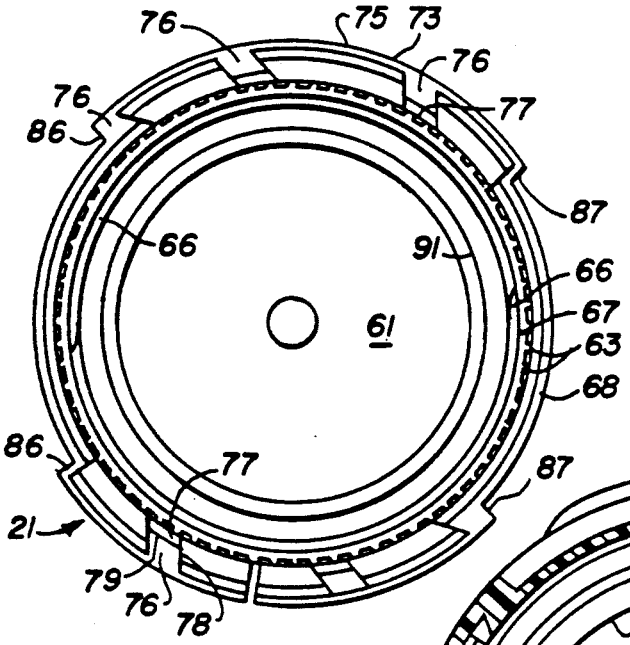
FIG. 11 is a bottom plan view.
Figure 12:
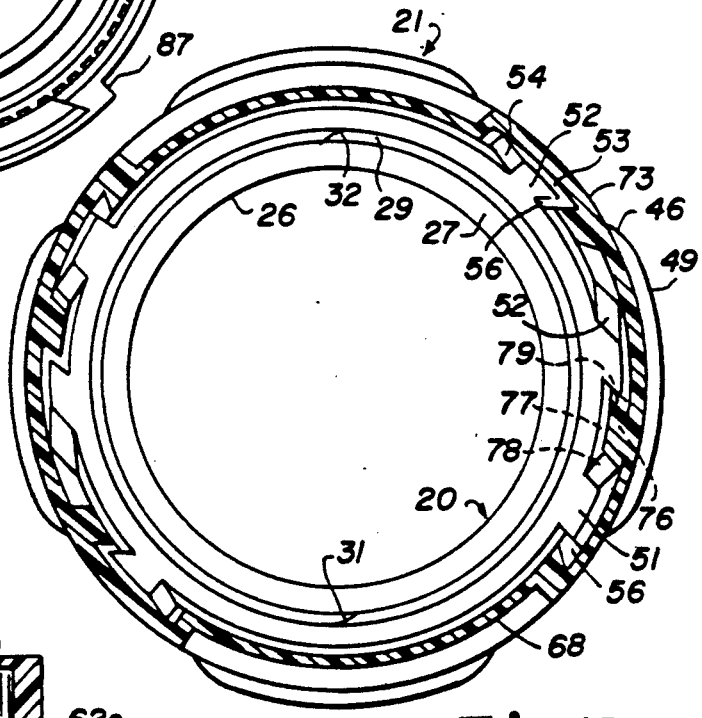
FIG. 12 is a top plan of the container neck (as in FIG. 2) showing the interfitting of the cap ratchets and the neck ratchets.
Figure 14:
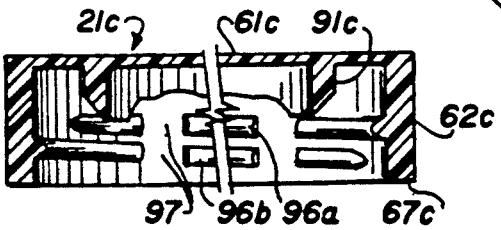
FIG. 14 is a vertical sectional view through a modified cap.
Figure 13:
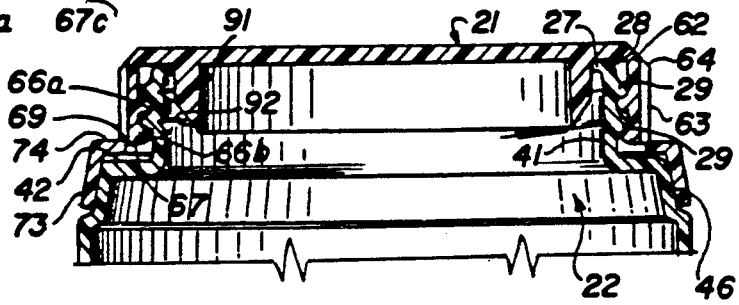
FIG. 13 is vertical sectional view through the neck and closure.

As shown in FIG. 14, threads **96*a*, 96*b* resemble threads 66 shown in FIG. 9, except that they are formed with interruptions 97. The interruptions 97 are preferably vertically aligned for ease of application and also for venting gas pressure within the container (e.g., carbonated beverages) prior to complete removal of the cap. Preferably complementary interruptions are formed in the container neck threads. Only the upper portion of the cap skirt 62*c* is shown in FIG. 14**, the lower portion being similar to the preceding modification. In this modification, many of the elements resemble those of the previous modification and the same reference numerals followed by subscript c designate corresponding parts.

In the preferred embodiment illustrated, diametrically opposite locking quadrants 73 extend outwardly from skirt 68 and each occupies substantially 90° of arc. Each quadrant 73 has outer wall 75 parallel to lower skirt 68, a leading edge 86 and a trailing edge 87 joined by horizontal top surface 74, so that the quadrants 73 are closed off on the outside top, sides, front and rear but are open on the bottom. On the inner walls of quadrant 73 are teeth 76 spaced and dimensioned to match the teeth 51 of neck 22. The inner edges 77 of the teeth are positioned to engage inner surface 46. The leading edge 79 of each tooth 76 is formed at an angle of approximately 45° to a radial line, thereby ensuring good interlock with the complimentary surface 56 of neck 22. This angular relationship biases the cap 21 into a more secure locking arrangement with the neck 22. Instead of protruding locking quadrants 73, the lower skirt 68 may be conical and co-extensive with outer wall 75. Thus the lower skirt 68 is smooth instead of having projections where quadrants 73 are located.

Tear tab 81 extends downwardly from lower edge 71 and an upper side edge thereof merges with a weakened vertically extending line 82 formed in skirt 68 approximately midway of the arcuate length of one of the quadrants 73. Line 82 is spanned by plural bridges 84 (see FIG. 9) which join tab 81 to skirt 68. When the consumer grips tab 81, bridges 84 are severed. Gripping ribs 83 assist the user in pulling the tear tab 81 circumferentially around cap 21 and thereby removing lower skirt 68 therefrom. The attachment of lower skirt 68 to the upper portion of cap 21 is accomplished by the bridges 69 between the upper edge of skirt 68 or quadrant top surface 74 and the bottom edges of ribs 63. Thus pulling the tab 81 sequentially fractures bridges 84 and then each of the bridges 69. Removal of the lower skirt 68 removes the ratchet teeth 76 and hence frees the upper portion of the cap so that it can be unscrewed. However, such removal of the lower skirt gives evidence of the opening of the cap and hence is a tamper-evident feature. Alternatively, the user may twist upper skirt 62, severing bridges 69.

Although various liners may be used to secure the under side of disk 61 to the lip flange 27 of neck 22, in the accompanying drawings, a preferred embodiment shows an inner skirt 91 extending downward from top disk 61 and fitting inside the neck opening 26. Preferably the outer bottom edge of skirt 91 is formed with a bevel 92 to facilitate seating of the cap 21 on the neck 22.

PREFERRED OPERATION

Figure 15:
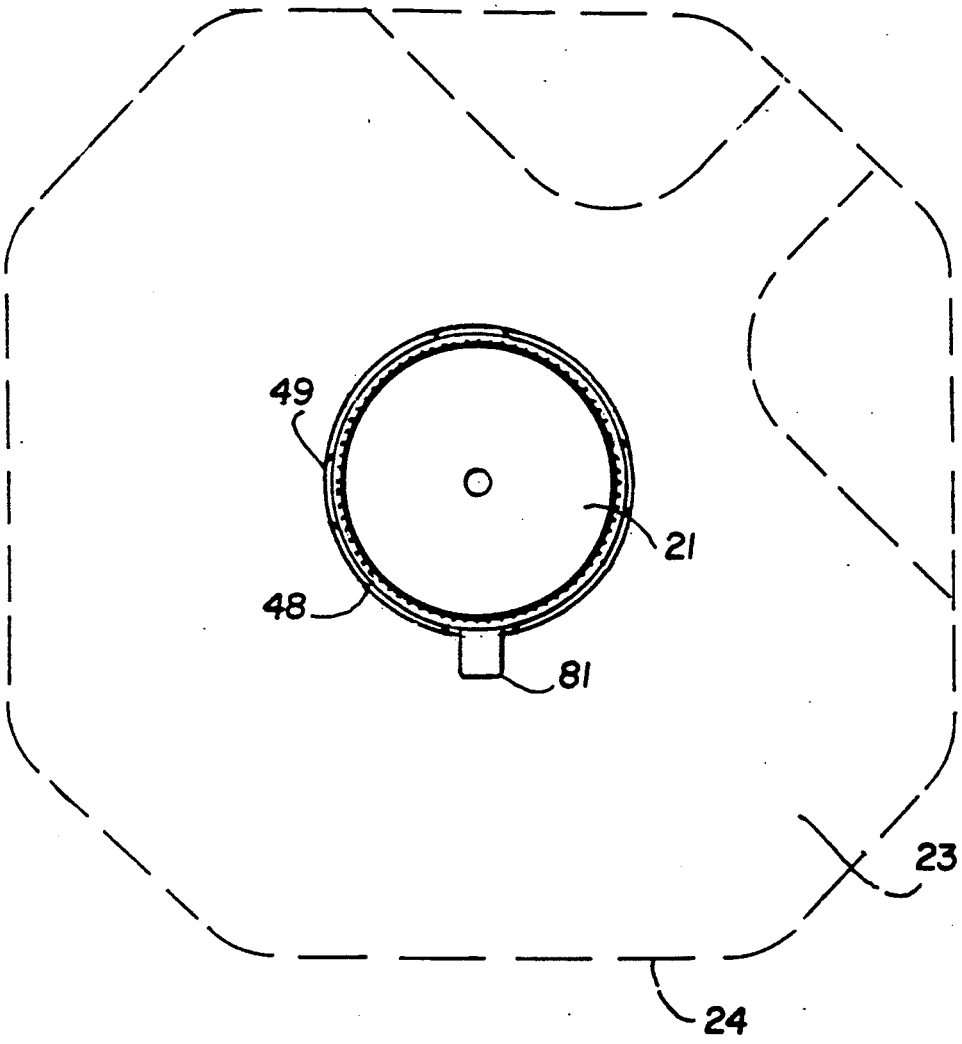
FIG. 15 is a top plan view of a preferred closure in accordance with the present invention shown fully seated on a container.

After the container has been filled, it is transported through a capping machine. As is well understood in the bottling art, and in a manner similar to that whereby push-on, pull-off caps are applied, the caps 21 are fed one at a time out of a bowl in the capping machine, the tear tabs 81 orienting the caps so that they are all discharged in a pre-determined orientation relative to the containers which pass therebelow. As shown in FIG. 15, container 23 has a square cross-section with side 24 providing container orientation means for properly aligning the container relative to the closure orientation means, such as tab 81, of cap 21. Alternatively, container 23 may have some other variation from a round shape which permits the container to be oriented relative to the cap 21. The structure of capping machines is well known in the bottling art. Because of the relative orientation of the cap 21 and container neck 22, the teeth 76 of the cap are in vertical alignment with the teeth 51 of neck 22. An axially downward force is applied to cap 21 causing it to move down. As it moves down, the inner skirt 91 fits inside neck opening 26. The threads 66*a* and 66*b* slip over the threads 29*a* and 29*b*, the slanted surfaces 36 facilitating such movement. The cap 21 is sufficiently resilient so that it expands outward sufficiently to permit the threads to slip. As the cap 21 seats on the neck 22, the teeth 76 engage behind the teeth 51 to fully seat the teeth 76 in place. Flange 27 then engages the under side of disk 61 and the outer wall of inner skirt 91, sealing the container. The engagement of threads 66 and 29 likewise seals the cap.

After the cap has been fully seated on neck 22 it cannot be removed without giving evidence of tampering. Thus the interengagement of teeth 76 and 51 prevent unscrewing the cap and the interengagement of threads 66 with threads 29 prevents lifting the cap off the neck.

When it is desired to open the container, the user grips the tab 81, thence pulls circumferentially around the container causing the lower skirt 68 and quadrants 73 to be removed. Removal of quadrants 73 removes the teeth 76. This gives evidence of tampering. However, it also permits the user to grip the ribs 63 and unscrew the cap 21 from neck 22. To replace the cap, it is merely necessary to reverse the direction of turning.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In combination, a container neck and a container closure, said neck having an upper opening, a first downward extending neck stretch portion below said opening, said first neck stretch portion having an exterior, at least one first helical engagement means around said exterior of said first neck stretch portion, a locking wall portion below said first neck stretch portion, at least one external tooth on said locking wall portion, said closure having a top, a downward extending upper skirt portion depending from said top, said upper skirt portion having an interior, at least one second helical engagement means around said interior of said upper skirt portion shaped to make with said at least one first helical engagement means, a lower skirt portion below said upper skirt portion, frangible means joining said upper and lower skirt portions together, at least one internal tooth on said lower skirt portion shaped to engage said at least one external tooth to prevent unscrewing of said closure relative to said neck without breaking said frangible means, said at least one first and second helical engagement means being shaped so that when said closure is moved directly axially downward on said neck without rotation of said closure relative to said neck, said at least one first and second helical engagement means slip past each other, said upper skirt portion being flexible to permit said at least one first and second helical engagement means to slip past each other and then to interengage, orientation means on said closure to orient said closure relative to said neck whereby direct axial downward movement of said closure on said neck without rotation of said closure relative to said neck causes said internal tooth to be substantially in side-by-side contact with said external tooth to restrain unscrewing of said closure relative to said neck so long as said frangible means is intact.

2. In combination, a container neck and a container closure, said neck having an upper opening, a first downward extending neck stretch portion having an exterior below said opening, at least one first helical engagement means around said exterior of said first neck stretch portion, a locking wall portion below said first neck stretch portion, at least one external tooth on said locking wall portion, said closure having a top, a downward extending upper skirt portion having an interior depending from said top, at least one second helical engagement means around said interior of said upper skirt portion shaped to mate with said at least one first helical engagement means, a lower skirt portion below said upper skirt portion, frangible means joining said upper and lower skirt portions together, at least one internal tooth on said lower skirt portion shaped to engage said at least one external tooth to prevent unscrewing of said closure relative to said neck without breaking said frangible means, said at least one first and second helical engagement means being shaped so that when said closure is moved directly axially downward on said neck, said at least one first and second helical engagement means slip past each other, said upper skirt portion being flexible to permit said at least one first and second helical engagement means to slip past each other and then to interengage, orientation means on said closure to orient said closure relative to said neck whereby direct axial downward movement of said closure on said neck causes said internal tooth to be substantially in side-by-side contact with said external tooth to restrain unscrewing of said closure relative to said neck so long as said frangible means is intact, said orientation means comprising a member integral with said closure extending outwardly relative to said closure to a position where said member is engageable with external orientation means to orient said closure about its longitudinal axis so that said internal tooth is located above, but radially displaced relative to, said external tooth in a direction opposite to the direction of unscrewing of said closure from said neck after said closure has been seated on said neck.

3. The combination of claim 2 which further comprises means to remove said lower skirt from said closure.

4. The combination of claim 3 in which said means to remove said lower skirt comprises a tear tab connected to said lower skirt and extending away from said lower skirt for convenient access by the user, said tear tab comprising said orientation means.

5. The combination of claim 2 in which said at least one first and second helical engagement means are screw threads.

6. The combination of claim 2 in which said frangible means comprises a plurality of spaced links.

7. The combination of claim 2 in which said lower skirt portion comprises at least one outward protruding locking segment, said at least one internal tooth being located on the inside of said at least one locking segment.

8. The combination of claim 7 in which said at least one internal tooth has a top surface, inner edge, leading edge wall and trailing edge wall joined to said at least one locking segment.

9. The combination of claim 8 in which said at least one locking segment slants downward-outward.

10. The combination of claim 2 in which said at least one external tooth has a top wall, outer wall, leading edge and trailing edge joined to said locking wall portion.

11. In combination, a container neck and a container closure, said neck having an upper opening, said first neck stretch portion having an exterior, a first downward extending neck stretch portion below said opening, at least one first helical engagement means around said exterior of said first neck stretch portion, a locking wall portion below said first neck stretch portion, at least one external tooth on said locking wall portion, said closure having a top, a downward extending upper skirt portion depending from said top, said upper skirt portion having an interior, at least one second helical engagement means around said interior of said upper skirt portion shaped to mate with said at least one first helical engagement means, a lower skirt portion below said upper skirt portion, frangible means joining said upper and lower skirt portions together, at least one internal tooth on said lower skirt portion shaped to engage said at least one external tooth to prevent unscrewing of said closure relative to said neck without breaking said frangible means, orientation means on said closure to orient said closure relative to said neck whereby direct axial downward movement of said closure on said neck without rotation of said closure relative to said neck causes said at least one internal tooth and said at least one external tooth to interengage and said at least one second helical engagement means to slip over said at least one first helical engagement means and then to interengage, said upper skirt being formed with external ribs having lower edges, said lower edges of said ribs comprising said frangible means.

12. In combination, a container neck and a container closure, said neck having an upper opening, a first downward extending neck stretch portion below said opening having an exterior, at least one first helical engagement means around said exterior of said first neck stretch portion, a locking wall portion below said first neck stretch portion, at least one external tooth on said locking wall portion, said closure having a top, a downward extending upper skirt portion having an interior depending from said top, at least one second helical engagement means around said interior of said upper skirt portion shaped to mate with said at least one first helical engagement means, a lower skirt portion below said upper skirt portion, frangible means joining said upper and lower skirt portions together, at least one internal tooth on said lower skirt portion shaped to engage said at least one external tooth to prevent unscrewing of said closure relative to said neck without breaking said frangible means, orientation means on said closure to orient said closure relative to said neck whereby direct axial downward movement of said closure on said neck without rotation of said closure relative to said neck causes said at least one internal tooth and said at least one external tooth to interengage and said at least one second helical engagement means to slip over said at least one first helical engagement means and then to interengage, said at least one first and second helical engagement means being multi-lead, whereby said closure tends to rest horizontally on said neck prior to said downward movement.

13. In combination, a container neck and a container closure, said neck having an upper opening, a first downward extending neck stretch portion having an exterior below said opening, at least one first helical engagement means around said exterior of said first neck stretch portion, a locking wall portion below said first neck stretch portion, at least one external tooth on said locking wall portion, said closure having a top, a downward extending upper skirt having an interior depending from said top, at least one second helical engagement means around said interior of said upper skirt portion shaped to mate with said at least one first helical engagement means, a lower skirt portion below said upper skirt portion, frangible means joining said upper and lower skirt portions together, at least one internal tooth on said lower skirt portion shaped to engage said at least one external tooth to prevent unscrewing of said closure relative to said neck without breaking said frangible means, said at least one first and second helical engagement means being shaped so that when said closure is moved directly axially downward on said neck without rotation of said closure relative to said neck, said at least one first and second helical engagement means slip past each other, said upper skirt portion being flexible to permit said at least one first and second helical engagement means to slip past each other and then to interengage, orientation means on said closure to orient said closure relative to said neck whereby direct axial downward movement of said closure on said neck without rotation of said closure relative to said neck causes said internal tooth to be substantially in side-by-side contact with said external tooth to restrain unscrewing of said closure relative to said neck so long as said frangible means is intact, said at least one external tooth having a top wall, outer wall, leading edge and trailing edge joined to said locking wall portion, in which each said at least one external tooth has said outer wall slanting approximately parallel to said locking wall.

14. In combination, a container neck and a container closure, said neck having an upper opening, a first downward extending neck stretch portion having an exterior below said opening, at least one first helical engagement means around said exterior of said first neck stretch portion having an exterior, a locking wall portion below said first neck stretch portion, at least one external tooth on said locking wall portion, said closure having a top disk, a downward extending upper skirt portion having an interior depending from said disk, at least one second helical engagement means around said interior of said upper skirt portion shaped to mate with said at least one first helical engagement means, a lower skirt portion below said upper skirt portion, frangible means joining said upper and lower skirt portions together, at least one internal tooth on said lower skirt portion shaped to engage said at least one external tooth to prevent unscrewing of said closure relative to said neck without breaking said frangible means, said at least one first and second helical engagement means being shaped so that when said closure is moved directly axially downward on said neck, said at least one first and second helical engagement means slip past each other, said upper skirt portion being flexible to permit said at least one first and second helical engagement means to slip past each other and then to interengage, orientation means on said closure to orient said closure relative to said neck whereby direct axial downward movement of said closure on said neck without rotation of said closure substantially in side-by-side contact with said external tooth to restrain unscrewing of said closure relative to said neck so long as said frangible means is intact, in which the leading edge wall of each said at least one external tooth viewed from above slants upwardly-forwardly in clockwise direction.

15. The combination of claim 14 in which the angle of slant of said leading edge wall is approximately 60° to horizontal.

16. In combination, a container neck and a container closure, said neck having an upper opening, a first downward extending neck stretch portion having an exterior below said opening, at least one first helical engagement means around said exterior of said first neck stretch portion, a locking wall portion below said first neck stretch portion, at least one external tooth on said locking wall portion, said closure having a top, a downward extending upper skirt portion having an interior depending from said top, at least one second helical engagement means around said interior of said upper skirt portion shaped to mate with said at least one first helical engagement means, a lower skirt portion below said upper skirt portion, frangible means joining said upper and lower skirt portions together, at least one internal tooth on said lower skirt portion shaped to engage said at least one external tooth to prevent unscrewing of said closure relative to said neck without breaking said frangible means, said at least one first and second helical engagement means being shaped so that when said closure is moved directly axially downward on said neck, said at least one first and second helical engagement means slip past each other, said upper skirt portion being flexible to permit said at least one first and second helical engagement means to slip past each other and then to interengage, orientation means on said closure to orient said closure relative to said neck whereby direct axial downward movement of said closure on said neck without rotation of said closure relative to said neck causes said internal tooth to be substantially in side-by-side contact with said external tooth to restrain unscrewing of said closure relative to said neck so long as said frangible means is intact, and in which said at least one first helical engagement means has an upper flank which slants outwardly-downwardly.

17. The combination of claim 16 in which said upper flank slants at about 45° to the horizontal.

18. A container closure for use with a container neck of the type having an upper opening, a first downward extending neck stretch portion having an exterior below said opening, at least one first helical engagement means around said exterior of said first neck stretch portion, a locking wall portion below said first neck stretch portion, at least one external tooth on said locking wall portion, said closure comprising a top, a downward extending upper skirt portion depending from said top, at leastone second helical engagement means around said interior of said upper skirt portion shaped to mate with said at least one first helical engagement means, a lower skirt portion below said upper skirt portion, frangible means joining said upper and lower skirt portions together, at least one internal tooth on said lower skirt portion shaped to engage said at least one external tooth to prevent unscrewing of said closure relative to said neck without breaking said frangible means, said at least one second helical engagement means being shaped complementary to the shape of said at least one first helical engagement means so that when said closure is moved directly axially downward on said neck, said at least one second helical engagement means and said at least one first helical engagement means slip past each other, said upper skirt portion being flexible to permit said at least one second helical engagement means and said at least one first helical engagement means to slip past each other and then to interengage, orientation means on said closure to orient said closure relative to said neck whereby direct axial downward movement of said closure on said neck without rotation of said closure relative to said neck causes said internal tooth to be substantially in side-by-side contact with said external tooth to restrain unscrewing of said closure relative to said neck so long as said frangible means is intact.

19. The closure of claim 18 in which said frangible means comprises a plurality of spaced links.

20. The closure of claim 18 in which said lower skirt portion comprises at least one outward protruding locking segment, said at least one internal tooth being located on the inside of said at least one locking segment.

21. The closure of claim 20 in which said at least one internal tooth has a top surface, inner edge, leading edge wall and trailing edge wall joined to said at least one locking segment.

22. The closure of claim 21 in which said at least one locking segment slants downward-outward.

23. The closure of claim 18 in which said at least one second helical engagement means comprises a thread having an upper flank which slants downwardly-inwardly.

24. The closure of claim 23 in which said upper flank slants at about 30° to the horizontal.

25. A container closure for use with a container neck of the type having an upper opening, a first downward extending neck stretch portion having an exterior below said opening, at least one first helical engagement means around said exterior of said first neck stretch portion, a locking wall portion below said first neck stretch portion, at least one external tooth on said locking wall portion, said closure comprising a top, a downward extending upper skirt portion having an interior depending from said top, at least one second helical engagement means around said interior of said upper skirt portion shaped to mate with said at least one first helical engagement means, a lower skirt portion below said upper skirt portion, frangible means joining said upper and lower skirt portions together, at least one internal tooth on said lower skirt portion shaped to engage said at least one external tooth to prevent unscrewing of said closure relative to said neck without breaking said frangible means, said at least one second helical engagement means being shaped complementary to said shape of said at least one first helical engagement means so that when said closure is moved directly axially downward on said neck, said at least one second helical engagement means and said at least one first helical engagement means slip past each other, said upper skirt portion being flexible to permit said at least one second helical engagement means and said at least one first helical engagement means to slip past each other and then to interengage, orientation means on said closure to orient said closure relative to said neck whereby direct axial downward movement of said closure on said neck without rotation of said closure relative to said neck causes said internal tooth to be substantially in side-by-side contact with said external tooth to restrain unscrewing of said closure from said neck so long as said frangible means is intact, said at least one second helical engagement means being a screw thread.

26. A container closure for use with a container neck of the type having an upper opening, a first downward extending neck stretch portion having an exterior below said opening, at least one first helical engagement means around said exterior of said first neck stretch portion, a locking wall portion below said first neck stretch portion, at least one external tooth on said locking wall portion, said closure comprising a top, a downward extending upper skirt portion having an interior depending from said top, at least one second helical engagement means around said interior of said upper skirt portion shaped to mate with said at least one first helical engagement means, a lower skirt portion below said upper skirt portion, frangible means joining said upper and lower skirt portions together, at least one internal tooth on said lower skirt portion shaped to engage said at least one external tooth to prevent unscrewing of said closure relative to said neck without breaking said frangible means, orientation means on said closure to orient said closure relative to said neck whereby direct axial downward movement of said closure on said neck without rotation of said closure relative to said neck causes said at least one internal tooth and said at least one external tooth to interengage with said internal tooth in substantially side-by-side contact with said external tooth to restrain unscrewing of said closure relative to said neck so long as said frangible means is intact and causes said at least one second helical engagement means to slip over said at least one first helical engagement means and then to interengage, said at least one second helical engagement means being multi-lead, whereby said closure tends to rest horizontally on said neck prior to said downward movement.

27. A container neck for use with a container closure of the type having a top, a downward extending upper skirt portion having an interior depending from the top, at least one first helical engagement means around said interior of said upper skirt portion, a lower skirt portion below said upper skirt portion, a frangible means joining said upper and lower skirt portions together, at least one internal tooth on said lower skirt portion and orientation means on said closure to orient said closure relative to said neck, said neck having an upper opening, a downward extending neck stretch portion having an exterior below said opening, at least one second helical engagement means around said exterior of said neck stretch portion shaped to mate with said at least one first helical engagement means, a locking wall portion below said neck stretch portion, at least one external tooth on said locking wall portion, said at least one external tooth being shaped to engage said at least one internal tooth of said closure to prevent unscrewing of said closure relative to said neck without breaking said frangible means, said at least complementary to said at least one first helical engagement means so that when said closure is moved directly axially downward on said neck, said at least one second helical engagement means and said at least one first helical engagement means slip past each other, said at least one second helical engagement means having an upper flank slanted downwardly-outwardly at a first angle to the horizontal and a lower flank slanted downwardly-inwardly at a second angle to the horizontal with said first angle being substantially greater than said second angle, said upper skirt portion being flexible to permit said at least one second helical engagement means to slip past said at least one first helical engagement means and then to interengage, whereby direct axial downward movement of said closure on said neck without rotation of said closure relative to said neck causes said at least one internal tooth to be substantially in side-by-side contact with said at least one external tooth to restrain unscrewing of said closure relative to said neck so long as the frangible means is intact, said orientation means comprising a member integral with said closure extending outwardly relative to said closure to a position where said member is engageable with external orientation means to orient said closure about its longitudinal axis so that said internal tooth is located above, but radially displaced relative to, said external tooth in a direction opposite to the direction of unscrewing of said closure from said neck after said closure has been seated on said neck.

28. A neck according to claim 27 in which said at least one external tooth has a top wall, outer wall, leading edge wall and trailing edge wall joined to said locking wall portion.

29. The neck of claim 28 in which said locking wall portion slants downward-outward.

30. The neck of claim 28 in which said outer wall surface slants approximately parallel to said locking wall portion.

31. The neck of claim 28 in which the leading edge wall of said at least one external tooth, viewed from above, slants upwardly-forwardly in a clockwise direction.

32. The neck of claim 31 in which the angle of slant of said leading edge wall is approximately 60° to horizontal.

33. The neck of claim 27 in which said upper flank slants at about 45° to the horizontal.

34. A container closure for use with a container neck of the type having an upper opening, a first portion below the opening, at least one first helical engagement means around the exterior of the first portion, a locking wall portion below the first portion and a first rachet means on the locking wall portion, said closure comprising a top disk, a peripheral upper skirt portion depending from said disk, at least one second helical engagement means around the interior of said upper skirt portion shaped to mate with the at least one first helical engagement means, a lower skirt portion below said upper skirt portion having a first width, frangible means joining said upper and lower skirt portions together, at least one outward protruding locking segment extending from said lower skirt portion having a second width greater than said first width, and second ratchet means on said at least one locking segment shaped to engage the first ratchet means to prevent unscrewing of said closure relative to the neck without breaking said frangible means.

35. A closure according to claim 34 in which there are two of said at least one locking segments diametrically opposed.

36. A closure according to claim 35 in which each of said at least one locking segment occupies substantially 90° of arc.

37. A container closure for use with a container having a neck and container orientation means to orient said neck during application of the cap to said container, said neck being of the type having an upper opening, a first downward extending neck stretch portion having an exterior below the opening, at least one first helical engagement means around said exterior of said first neck stretch portion, a locking wall portion below said first neck stretch portion, at least one external tooth on said locking wall portion, said closure comprising a top, a downward extending upper skirt portion having an interior depending from said top, at least one second helical engagement means around said interior of said upper skirt portion shaped to mate with said at least one first helical engagement means, a lower skirt portion below said upper skirt portion, frangible means joining said upper and lower skirt portions together, at least one internal tooth on said lower skirt portion shaped to engage said at least one external tooth to prevent unscrewing of said closure relative to said neck without breaking said frangible means, said at least one second helical engagement means being shaped complementary to the shape of said at least one first helical engagement means so that when said closure is moved directly axially downward on said neck, said at least one second helical engagement means and said at least one first helical engagement means slip past each other, said upper skirt portion being flexible to permit said at least one second helical engagement means and said at least one first helical engagement means to slip past each other and then to interengage, closure orientation means on said closure to orient said closure on said neck relative to said container orientation means whereby direct axial downward movement of said closure on said neck without rotation of said closure relative to said neck causes said internal tooth to be substantially in side-by-side contact with said external tooth to restrain unscrewing of said closure relative to said neck so long as said frangible means is intact.

38. The closure of claim 37 which further comprises means to remove said lower skirt from said closure.

39. The closure of claim 38 in which said lower skirt is weakened in a line extending from bottom to top of said lower skirt, said means to remove said lower skirt comprising a tear tab connected to said lower skirt adjacent said weakened line.

40. The closure of claim 39 in which said closure orientation means comprises said tear tab.

41. In combination, a container having a neck and a container closure;

said neck having an upper opening, a downward extending neck stretch having an outside below said opening, at least one first helical engagement means formed around said outside of said neck stretch, first tamper-evident means on said neck, first orientation means on said container, said closure having a top, a downward extending upper skirt portion having an inside depending from said top adapted to fit over said neck stretch, at least one second helical engagement means formed around said inside of said upper skirt portion shaped to mate with said at least one first helical engagement means, second tamper-evident means, frangible means joining said second tamper-evident means to said upper skirt portion, second orientation means on said closure, said first and second helical engagement means being shaped and said closure being resilient so that upon application of force to accomplish direct, axial movement of said closure relative to said container said first and second helical engagement means slip past each other and then interengage and said closure seats on said neck so that said closure cannot be removed from said neck without unscrewing said closure, said first tamper-evident means having first engagement means, said second tamper-evident means having second engagement means, said first and second engagement means being shaped and positioned to interengage when said closure seats on said neck, said first and second orientation means being positioned to be engaged by respective first and second external orientation means to orient said closure relative to aid container so that, upon application of said force to accomplish said direct axial movement of said closure relative to said container without rotation of said closure relative to said container, said first and second engagement means interengage to prevent unscrewing of said closure from said neck so long as said frangible means is intact, said orientation means comprising a member integral with said closure extending outwardly relative to said closure to a position where said member is engageable with external orientation means to orient said closure about its longitudinal axis so that said second engagement means is located above, but radially displaced relative to, said first engagement means in a direction opposite to the direction of unscrewing of said closure from said neck after said closure has been seated on said neck.

42. The combination of claim 41 in which said member comprises a tear tab extending from said second tamper-evident means in a direction substantially parallel to the longitudinal axis of said closure.

43. The combination of claim 41 in which said member extends radially outwardly of said closure.

* * * * *